United States Patent [19]

Porat

[11] Patent Number: 4,614,095

[45] Date of Patent: Sep. 30, 1986

[54] METHOD AND APPARATUS FOR OPERATING WARP KNITTING MACHINES

[75] Inventor: Itzchak Porat, Leeds, United Kingdom

[73] Assignee: Guilford Mills, Inc., Greensboro, N.C.

[21] Appl. No.: 710,008

[22] Filed: Mar. 11, 1985

[30] Foreign Application Priority Data

Mar. 13, 1984 [GB] United Kingdom ..... 8406570

[51] Int. Cl.[4] ..... D04B 23/00

[52] U.S. Cl. ..... 66/207

[58] Field of Search ..... 66/203, 204, 205, 231; 364/470; 112/277

[56] References Cited

U.S. PATENT DOCUMENTS

| | | | |
|---|---|---|---|
| 3,006,170 | 10/1961 | Chapuis . | |
| 3,762,184 | 10/1973 | Schur et al. | 66/205 |
| 3,825,900 | 7/1974 | Anderson | 66/205 X |
| 3,978,690 | 9/1976 | Beling et al. | 66/205 |
| 4,430,870 | 2/1984 | Winter et al. | 66/203 |
| 4,481,507 | 11/1984 | Takiguchi et al. | 112/277 |
| 4,501,210 | 2/1985 | Hanyu et al. | 112/277 |
| 4,528,631 | 7/1985 | Bogucki-Land | 66/205 |

FOREIGN PATENT DOCUMENTS

| | | |
|---|---|---|
| 2164013 | 7/1972 | Fed. Rep. of Germany . |
| 1352857 | 5/1974 | United Kingdom . |
| 1361872 | 7/1974 | United Kingdom . |
| 1425702 | 2/1976 | United Kingdom . |
| 1445374 | 8/1976 | United Kingdom . |
| 1473344 | 5/1977 | United Kingdom . |
| 2043299 | 10/1980 | United Kingdom . |
| 2057515 | 4/1981 | United Kingdom . |
| 2050446 | 7/1981 | United Kingdom . |

*Primary Examiner*—Ronald Feldbaum

*Attorney, Agent, or Firm*—Shefte, Pinckney & Sawyer

[57] ABSTRACT

A method for operating the guide bars of warp knitting machines comprises feeding in to a computer desired lapping instructions, the computer being programmed to discriminate between permitted and prohibited lapping movements and being operative to prevent the attempted execution of prohibited movements. The computer can be programmed to test instructions against a set of mandatory rules, which proscribe lapping movements that would crash the guide bars, and may also be programmed to discriminate against ineffective lapping movements.

11 Claims, 7 Drawing Figures

BACK BAR. FRONT BAR.

0-0, 2-2 : 1-0, 0-1

0-2 , 2-0

0-3 , 3-0

METHOD AND APPARATUS FOR OPERATING WARP KNITTING MACHINES

BACKGROUND TO THE INVENTION

This invention relates to operating warp knitting machines.

Conventionally the guide bars of warp knitting machines are controlled by pattern wheel or pattern chains which are in effect cams pushing the guide bars against resilient means biassing them against the cams. Because the pattern chains and pattern wheels, though reliable in operation, are expensive in terms of time and money to construct and install in a warp knitting machine, alternative guide bar operation systems have been proposed. One such alternative system is described in our co-pending U.S. patent application Ser. No. 710,002, filed Mar. 11, 1985 filed contemporaneously herewith and comprises a hydraulic arrangement which can be operated under the control of a computer.

The use of a computer to control guide bar movements brings about the advantage that desired lapping instructions can by input much more readily than pattern wheels or chains can be assembled, and the testing of new fabric specifications becomes simplified and less costly.

BRIEF DESCRIPTION OF THE INVENTION

The present invention provides improved computer control of warp knitting machine guide bar movement.

The invention comprises a method for operating the guide bars of warp knitting machines comprising feeding in to a computer desired lapping instructions said computer being programmed to discriminate between permitted and prohibited lapping movements and being operative to prevent the attempted execution of prohibited movements.

Said computer may be programmed to test instructions against a set of mandatory rules to discriminate between permitted and prohibited lapping movements. One of said mandatory rules may restrict overlaps to one needle space and another of said mandatory rules may restrict underlaps to a number of needle spaces determined in accordance with machine speed.

Said computer may be connected to feed control signals directly to guide bar operating means and be operative not to feed such signals if instructions fed in to said computer are for prohibited lapping movements.

Said computer may also be programmed to discriminate between effective and ineffective lapping movements. Said computer may be programmed to test instructions against a set of advisory rules to discriminate between effective and ineffective lapping movements.

One of said advisory rules may require each needle that knits at all to knit at least one yarn on each course. One of said advisory rules may require adjacent wales to be connected at some point in a repeat. One of said advisory rules may require that a laid-in yarn does not turn around an empty needle. And one of said advisory rules may require that a knitting guide bar must precede a laying-in guide bar.

The computer may be connected to feed control signals directly to guide bar operating means and be operative to feed such signals despite instructions fed in to said computer for ineffective lapping movements, but to draw attention to such instructions' being for ineffective movement.

Said computer may receive synchronisation signals from a warp knitting machine under its control, and may be operable to control the speed of operation of such a knitting machine.

Said computer may also be operable to control inching of said knitting machine.

Said computer, moreover, may be operable to stop a knitting machine under its control with its knitting elements in a predetermined position. Said predetermined position may be one in which excessive yarn tensions are avoided, and may even be one in which yarn tensions are minimised.

Said computer may monitor operating variables of a knitting machine under its control.

The invention also comprises apparatus for operating the guide bars of warp knitting machines comprising a computer adapted to receive lapping instructions and being programmed to discriminate between permitted and prohibited lapping movements and being operative to prevent the attempted execution of prohibited movements.

Said computer may comprise a keyboard for inputting instructions and a visual display unit adapted to display information relative to such instructions and to operation of a knitting machine under the control of the computer. The computer may be connected to control a knitting machine directly and to receive synchronisation signals from said machine.

BRIEF DESCRIPTION OF THE DRAWINGS

Embodiments of apparatus and methods for operating the guide bars of warp knitting machines in accordance with the invention will now be described with reference to the accompanying drawings, in which.

DETAILED DESCRIPTION OF THE PREFERRED EMBODIMENTS

Figure 1:
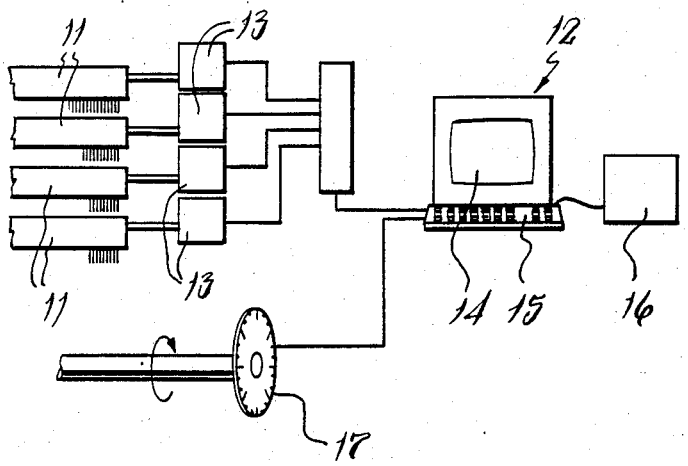
FIG. 1 is a diagrammatic representation of the apparatus.

The apparatus illustrated in FIG. 1 is for operating the guide bars 11 of a warp knitting machine and comprises a computer 12 adapted to receive lapping instructions and programmed to discriminate between permitted and prohibited lapping movements and operative to prevent the attempted execution of prohibited movements.

The guide bars 11 are moved by actuators 13 which can be hydraulic piston-in-cylinder arrangements controlled by electrically operated valves receiving electric operating signals from the computer 12.

The computer 12 comprises a visual display unit (VDU) 14 comprising a screen and a keyboard 15 as well as a stored program device 16 which can load different programs into the computer 11. The device 16 can for example be a disc or tape drive, or even a ROM or non-volatile RAM or EPROM cartridge.

Figure 2:
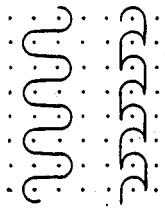
FIG. 2 is a point diagram of a permitted guide bar lapping movement.

Warp knitting constructions are specified in terms of lapping movements and threading instructions for the guide bars and can be represented graphically. FIG. 2 shows a point diagram of a two guide bar fabric in which the front bar is knitting open chain stitches in which each thread always knits on the same needle, and the back Bar is laying-in over two needles. These are permitted movements which are also effective. By "permitted" is meant that the movements give rise to no problem in operating the machine such as would cause damage to the yarns or knitting elements. "Effective" means that the movements will result in a fabric being knitted.

For the simple construction shown in FIG. 2 it would be specified, so far as threading is concerned, that the two bars are full set threaded, by which is, of course, meant that each guider is threaded with a yarn.

The notation conventionally adopted to describe the lapping motions for the FIG. 2 construction is Front Bar: 1–0, 0–1 and repeat Back Bar: 0–0, 2–2 and repeat The numbers indicate the height of link required in the conventional pattern chain to produce the required lapping movement, but equally well indicate the position of the guide bar, in terms of needle spaces, relative to a starting position ("0") at the pattern wheel or chain end of the machine.

This is a convenient notation, also, to input lapping instructions to a computer since, given the gauge of the machine, of which the reciprocal (in suitable units) gives the needle spacing, the numbers completely specify the required positions of the guide bar before and after each stitch-forming motion of the needle bar.

Threading instructions can be specified in a variety of ways. One way is to diagrammatically represent the filled guiders as a "1" and the empty guiders as a ".", but apart from the "full set" (which means, obviously, all guiders threaded) and "half set", which means alternate guiders threaded, the usual instruction is given in the form "1 in, 2 out" or "2 in, 2 out" and so on. Clearly, a computer can be programmed to "understand" any of these instructions.

Figure 3:
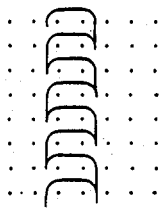
FIG. 3 is a point diagram of a prohibited movement.

FIG. 3 shows a lapping instruction that would ordinarily be regarded as prohibited. Notated 0–2, 2–0 and repeat, it forms, or attempts to form, an overlap over two needles. Ordinarily this causes high tensions which can damage the yarns and bend or break the knitting elements. The reason for this is that both needles attempt to form stitches and consume, even if only temporarily, comparatively long lengths of yarn in the loop formation. Occasionally this is permitted, but ordinarily fabrics do not use this kind of construction and the computer may be programmed to prevent operation of the machine if such a construction is inadvertently instructed.

Figure 4:
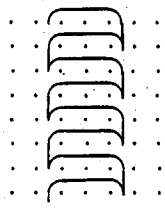
FIG. 4 is a point diagram of another prohibited movement.

FIG. 4 shows a three needle overlap notated as 0–3, 3–0. Such a construction is definitely prohibited.

Figure 5:
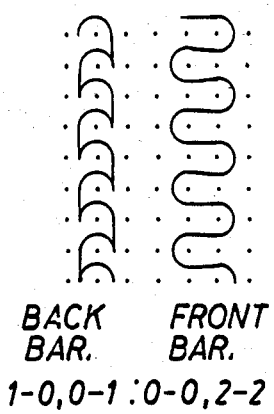
FIG. 5 is a point diagram of an ineffective movement.

FIG. 5 shows a two guide bar lapping movement in which the front Bar lays-in behind two needles and the back Bar knits open chain stitch. This would be ineffective to produce a fabric, although the knitting machine could be run. In the event of this instruction being given, the computer would permit operation of the machine, but return an error message that the construction would be ineffective.

Figure 6:
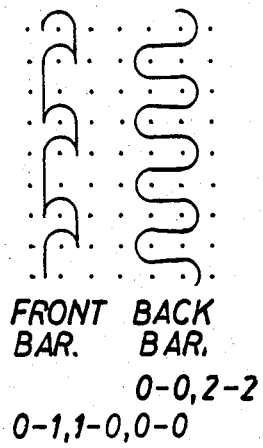
FIG. 6 is a point diagram of another ineffective movement.

FIG. 6 shows another ineffective movement in which the front Bar does not knit on every course and the back Bar does not knit on any needle-again, with this construction the computer would permit operation of the machine but return an error message that the movement would be ineffective.

Figure 7:
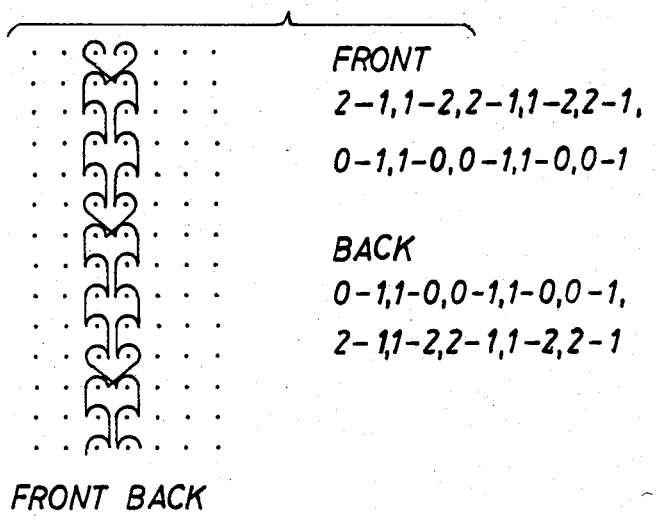
FIG. 7 is a point diagram of another ineffective movement.

FIG. 7 illustrates a construction in which the front and back bars make a sideways connection between wales of stitches every few courses. Were it not for this sideways connection in courses 1/2, 6/7 and so on, the computer would permit operation of the machine, but return an error message that the movement would be ineffective.

The computer program can comprise a set-up module in which lapping and threading instructions are input through the keyboard and edited in accordance with error messages from the checking section of the set-up module, and a run-time module in which the instructions are carried out by the computer outputting appropriate control signals to the guide bar actuators. In the run-time mode, the computer operates the guide tars in synchronism with the other knitting elements by virtue of the shaft encoder 17 and also makes any adjustments necessitated by changes in machine speed if, for example, the actuators were subject to inertia effects.

The run-time module also controls inching and the position in which the machine stops, in order to minimise tension in the yarn and resulting forces on the knitting elements.

Other system variables such for example as oil pressure and temperature in the case of hydraulic actuators, back-up battery charge state, and guide-bar drift, can be monitored and compared to nominal values in the computer and warning or corrective action taken in off-limits situations.

Keyboard input can also operate the machine in a "manual" mode for setting up initial guide bar positions—it would be desirable to provide fractional needle adjustments for this purpose—and also for adjusting guide bars for maintenance purposes.

Instead of a computer being permanently connected to a knitting machine, it would be possible to set up and edit a suitable program on a computer and then to store the resulting program in a memory device such as a disc or tape or a non-volatile RAM or EPROM for insertion into a microprocessor connected to the machine. In this way, a central computer can be used for creating programs without having also to execute them. On the other hand a computer of sufficient capacity could handle the task of program creation and also control the operation of several knitting machines simultaneously.

What I claim is:

1. A method for operating the guide bars of warp knitting machines to feed yarn to the needles thereof, said method comprising the steps of:

(a) providing actuator means for causing lapping movement of said guide bars in response to operating electronic signals being transmitted to said actuator means;

(b) programming a computer to distinguish between predetermined permitted lapping movement for said guide bars and prohibited lapping movements for said guide bars;

(c) inputting guide bar lapping movement instruction into said computer; and (d) generating said operating electronic signals from said computer and transmitting said signals to said actuator means to cause lapping movement of said guide bars only when said input lapping movement instructions correspond to said permitted lapping movements for said guide bars.

2. A method for operating the guide bars of warp knitting machines as defined in claim 1, and characterized further in that one of said predetermined prohitibed lapping movements includes a guide bar lapping movement that would form an overlap of said yarn two or more of said needles.

3. A method for operating the guide bars of warp knitting machines as defined in claim 1 and characterized further by the steps of:

(e) further programming said computer to distinguish between predetermined effective lapping movements for said guide bars and ineffective lapping movements for said guide bars;

(f) generating and transmitting said generated signal to said actuator means to cause lapping movement of said guide bars when said input lapping movement instructions correspond to said predetermined effective lapping movements and to said ineffective lapping movements; and (g) generating an error signal from said computer when said input lapping movement instruction corresponds to said ineffective lapping movements.

4. A method for operating the guide bars of warp knitting machines as defined in claim 1 and characterized further by the steps of:

(h) sensing the operating speed of said warp knitting machine, and providing an input signal to said computer which is a function of said sensed operating speed; and (i) programming said computer to generate a control signal that is transmitted to said actuator means to synchronize the lapping movement of said guide bars with the sensed speed of said warp knitting machine.

5. A method for operating the guide bars of warp knitting machines as defined in claim 1 and characterized further by the step of programming said computer to generate and transmit to said actuator means a stop signal for stopping further movement of said guide bars only when said guide bars are at predetermined positions at which said yarn is not under excessive tension.

6. Apparatus for operating the guide bars of a warp knitting machine to feed yarn to the needles thereof, said apparatus comprising:

(a) actuator means for causing lapping movement of said guide bars in response to electronic operating signals transmitted to said actuator means;

(b) computer control means including:

(i) progamming means for programming said computer control means to distinguish between predetermined permitted lapping movements for said guide bars and prohibited lapping movements for said guide bars;

(ii) input means for feeding input guide bar lapping movement instructions into said computer means; and (iii) means for gnerating said operating electronic signals and transmitting said signals to said actuator means only when said input guide bar lapping movement instruction correspond to said predetermined permitted lapping movements for said guide bar.

7. Apparatus for operating the guide bars of a warp knitting machine as defined in claim 6 and further characterized in that said programming means is further programmed to distinguish between predetermined effective lapping movements for said guide bars and ineffective lapping movements for said guide bars, and in that said signal generating and transmitting means generates and transmits said operating electronic signals to said actuator means when said input guide bar lapping movement instructions correspond to said predetermined effective lapping movements and to said ineffective lapping movements, and in that said computer control means includes means for generating an error signal when said input lapping movement instruction corresponds to said ineffective lapping movements.

8. Apparatus for operating the guide bars of a warp knitting machine as defined in claim 6 and further characterized in that said input means includes a keyboard for feeding said input guide bar lapping movement instructions into said computer control means, and in that said computer control means includes visual display means for displaying said input guide bar lapping movement instructions thereon.

9. Apparatus for operating the guide bars of a warp knitting machine as defined in claim 6 and further characterized in that shaft encoder means are provided for sensing the operating speed of said warp knitting machines and providing an input signal to said computer control means, and in that said actuator means to synchronize the lapping movement of said guide bars with the sensed speed of said warp knitting machines.

10. Apparatus for operating the guide bars of a warp knitting machine as defined in claim 6 and further characterized in that said programming means is programmed to generate and transmit to said actuator means a stop signal for stopping further movement of said guide bars only when said guide bars are at predetermine depositions at which said yarn is not under excessive tension.

11. Apparatus for operating the guide bars of a warp knitting machine as defined in claim 6 and further characterized in that said actuator means include hydraulic motors for moving said guide bars, and operating valves for said actuator means which are responsive to said operating electronic signal to control the operation of said hydraulic motors.

* * * * *